US011681238B2

(12) United States Patent
Azami

(10) Patent No.: US 11,681,238 B2
(45) Date of Patent: Jun. 20, 2023

(54) IMAGE FORMING METHOD AND IMAGE FORMING APPARATUS

(71) Applicant: Akira Azami, Kanagawa (JP)

(72) Inventor: Akira Azami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/722,402

(22) Filed: Apr. 18, 2022

(65) Prior Publication Data

US 2022/0350271 A1 Nov. 3, 2022

(30) Foreign Application Priority Data

Apr. 30, 2021 (JP) ..... JP2021-077720

(51) Int. Cl.
*G03G 15/02* (2006.01)

(52) U.S. Cl.
CPC ..... *G03G 15/0216* (2013.01)

(58) Field of Classification Search
CPC ..... G03G 15/1675; G03G 15/1605; G03G 15/1665; G03G 2215/0129
See application file for complete search history.

(56) References Cited

U.S. PATENT DOCUMENTS

2012/0045237 A1* 2/2012 Aoki ..... G03G 15/1675 399/66
2014/0023388 A1* 1/2014 Yoshida ..... G03G 15/14 399/101
2014/0112687 A1 4/2014 Ohmura et al.
2015/0338824 A1 11/2015 Shimizu et al.
2016/0238966 A1 8/2016 Oshikawa et al.
2017/0139367 A1 5/2017 Adachi
2021/0311416 A1 10/2021 Masuda et al.
2022/0075310 A1 3/2022 Kabata et al.

FOREIGN PATENT DOCUMENTS

EP 3 048 488 A1 7/2016
JP 2015-067433 4/2015
JP 2016-122154 7/2016
JP 2016-122155 A 7/2016
JP 2016-210575 12/2016
JP 2021-076723 5/2021

OTHER PUBLICATIONS

Extended European Search Report dated Sep. 28, 2022 in European Patent Application No. 22169429.2, 7 pages.

* cited by examiner

*Primary Examiner* — Jessica L Eley
(74) *Attorney, Agent, or Firm* — Xsensus LLP

(57) ABSTRACT

An image forming method includes forming, fixing, and applying. The forming forms a toner image on a recording medium by an image forming device. The fixing fixes the toner image on the recording medium with heat by a fixing device. The applying applies an electric charge by a charge applying device to the recording medium on which the toner image has been fixed by the fixing device, in a state in which an output-adjustable power source for the charge applying device has an electric current that is controlled to be constant.

14 Claims, 7 Drawing Sheets

IMAGE FORMING METHOD AND IMAGE FORMING APPARATUS

CROSS-REFERENCE TO RELATED APPLICATION

This patent application is based on and claims priority pursuant to 35 U.S.C. § 119 to Japanese Patent Application No. 2021-077720, filed on Apr. 30, 2021, in the Japan Patent Office, the entire disclosure of which is hereby incorporated by reference herein.

BACKGROUND

Technical Field

Exemplary aspects of the present disclosure relate to an image forming method and an image forming apparatus.

Related Art

Image forming apparatuses employing an electrophotographic method that uses high voltage to transfer toner to a printing medium such as a sheet are known. Since such a printing medium is charged with the high voltage at the time of toner transfer, a phenomenon in which printing media adhere to each other due to electrical attraction may occur in an output tray, or a phenomenon in which a printing medium electrostatically adheres to a metal component may occur in a conveyance path. Since each of such adhesion phenomena causes a sheet jam or becomes an issue when post-processing is performed on stacked sheets, a method such as the use of an electricity removal brush for removing a surface charge has been considered to avoid static electricity generation and electrical attraction.

However, when a printing medium, such as a resin film and a label, having a high electrical resistance is used, electricity is discharged in a small gap between the printing medium and a transfer roller. Such electric discharge causes not only a printing medium surface but also an area near the printing medium surface to be electrostatically charged. In a state in which an electric charge has entered inside the area near the printing medium surface, removal of the surface charge by the existing method which uses the electricity removal brush is not adequate. Thus, a method for applying a bias having a polarity opposite to a polarity at the time of toner transfer to reverse a charge polarity is known. In addition, for resolution of adhesion that occurs when printing is continuously performed on a plurality of sheets, a method for alternately changing a bias voltage to be applied is considered so that surfaces of sheets to be stacked are charged to electrically repel each other.

However, in a case where a printing medium having a high electrical resistance is repeatedly used, a resistance value of the printing medium is lowered due to a temperature rise of a bias application roller for application of a bias voltage. Consequently, any of the methods cannot solve an issue in which a charging potential of a printing medium surface fluctuates, and an issue in which a printing medium electrostatically adheres to a metal component in a conveyance path.

SUMMARY

In at least one embodiment of this disclosure, there is described an improved image forming method that includes forming, fixing, and applying. The forming forms a toner image on a recording medium by an image forming device. The fixing fixes the toner image on the recording medium with heat by a fixing device. The applying applies an electric charge by a charge applying device to the recording medium on which the toner image has been fixed by the fixing device, in a state in which an output-adjustable power source for the charge applying device has an electric current that is controlled to be constant.

Further described is an improved image forming apparatus that includes an image forming device, a fixing device, a charge applying device, and an output-adjustable power source. The image forming device forms a toner image on a recording medium. The fixing device fixes the toner image on the recording medium with heat. The charge applying device applies an electric charge to the recording medium on which the toner image has been fixed by the fixing device. The output-adjustable power source causes the charge applying device to apply the electric charge to the recording medium, in a state in which the output-adjustable power source has an electric current that is controlled to be constant.

BRIEF DESCRIPTION OF THE DRAWINGS

The aforementioned and other aspects, features, and advantages of the present disclosure are better understood by reference to the following detailed description when considered in connection with the accompanying drawings, wherein.

Figure 1:
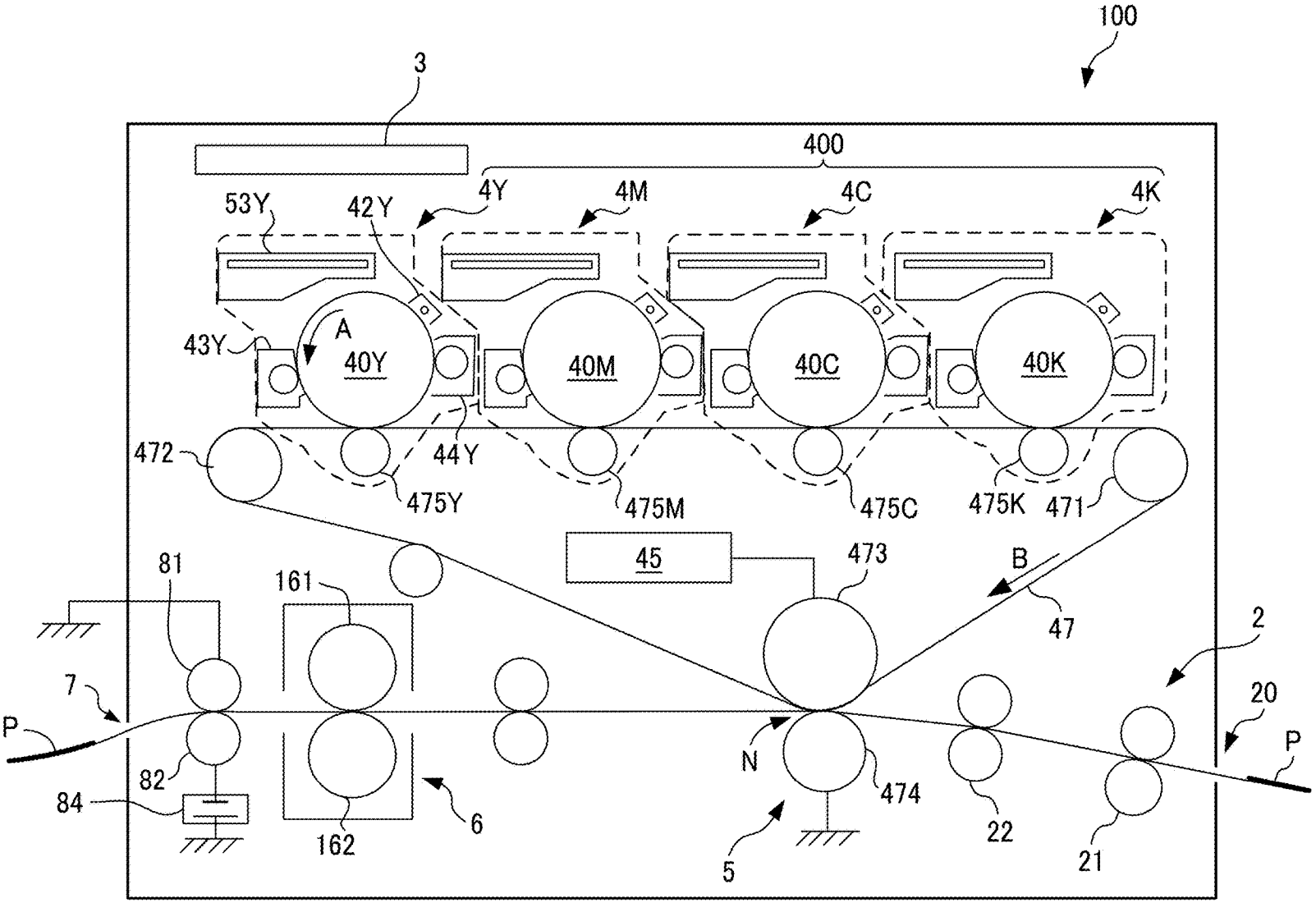
FIG. 1 is a diagram illustrating one example of a configuration of an image forming apparatus according to one embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Referring now to the drawings, embodiments of the present disclosure are described below. In the drawings for explaining the following embodiments, the same reference codes are allocated to elements (members or components)

having the same function or shape and redundant descriptions thereof are omitted below.

Hereinafter, one embodiment of the present disclosure is described. FIG. 1 schematically illustrates a general arrangement of an image forming apparatus 100 as one embodiment of the present disclosure.

In FIG. 1, the overall configuration of the image forming apparatus 100 is schematically illustrated as one example of an image forming system according to the present embodiment. In the present embodiment, the image forming apparatus 100 includes a sheet feeder 2, a controller 3, and an image forming device 400. The sheet feeder 2 conveys a sheet P as a recoding medium. The controller 3 forms image information based on source document data that has been input. The image forming device 400 is an electrophotographic printer engine that forms a toner image on a transfer belt 47 based on the image information. The image forming apparatus 100 also includes a registration roller pair 22 that feeds a sheet P supplied from the sheet feeder 2 to a transfer device 5 as a secondary transfer device at a prescribed time. In addition, the image forming apparatus 100 includes the transfer device 5, a fixing device 6, and a sheet ejector 7. The transfer device 5 transfers the toner image on the transfer belt 47 to the sheet P in a secondary transfer position N as a nip portion formed with the transfer belt 47. The fixing device 6 fixes the formed image, and the sheet ejector 7 ejects the sheet P to the outside.

The sheet feeder 2 includes a feed port 20, and a plurality of feed rollers 21 that convey a sheet P fed from the feed port 20 to the transfer device 5.

The controller 3 is a calculator, such as a computer, that comprehensively controls operations of the image forming apparatus 100. The controller 3 inputs, for example, a setting of the image forming apparatus 100, the number of sheets P to be printed, and a type of the sheet P to be printed. Herein, a description is given using an example in which a sheet P is a high-resistance medium such as a resin film, and a type of the sheet P is input via the controller 3. However, for example, information indicating a type of a medium may be recorded beforehand in a high-resistance medium. In such a case, the information indicating the medium type can be read in an image process, or can be, for example, optically or magnetically read, and the controller 3 can be notified of the read type.

In the controller 3, a sheet processing program for controlling application of a reverse voltage to a high-resistance medium is stored. In addition to the sheet processing program, information such as voltage control information indicating a reverse voltage value for each type of a high-resistance medium is stored in the controller 3. The controller 3 detects voltage control information corresponding to a high-resistance medium type which has been input beforehand, and instructs a constant-current power source 84 to apply a reverse voltage of a voltage value indicated by the voltage control information on an every-other-medium basis. Accordingly, each of contact surfaces of high-resistance media to he charged and overlapped as described below can have the same polarity, thereby preventing adhesion of each of the high-resistance media due to an electrical factor.

The image forming device 400 includes four process units 4Y, 4M, 4C, and 4K for respective colors of yellow (Y), magenta (M), cyan (C), and black (K) that is a plurality of basic colors. Since configurations of the four process units 4Y 4M, 4C, and 4K are similar to every other, only the process unit 4Y is described herein and redundant descriptions of the process units 4M, 4C, and 4K are omitted. The process unit 4Y includes a drum-shaped photoconductor 40Y that is an image bearer as a rotator, and a laser device 53Y as an optical writing device that is an optical scanner. The photoconductor 40Y rotates in a direction A that is a counterclockwise direction illustrated in FIG. 1. The photoconductor 40Y has a surface on which a photoconductive layer is formed. The photoconductive layer is a scanning target surface to which scanning light is emitted by the laser device 53Y In addition, the process unit 4Y includes a charging device 42Y, a developing device 43Y, and a primary transfer roller 475Y as a primary transfer device that are disposed around the photoconductor 40Y. The charging device 42Y is disposed upstream in the direction A. The primary transfer roller 475Y is disposed such that the transfer belt 47 is wound around. The process unit 4Y also includes a cleaning device 44Y disposed downstream from a position in which the primary transfer roller 475Y contacts the photoconductor 40Y in the direction A. In addition, the process unit 4Y includes a potential sensor that is a surface potential sensor as a surface potential detection device that detects a surface potential of the photoconductor 40Y The process unit 4Y forms a latent image on the photoconductor 40Y by using the laser device 53Y, so that a toner image of a basic color of yellow is formed, The image forming device 400 uses the four process units 4Y, 4M, 4C, and 40K to output a toner image to a sheet P based on image information that is an image data array formed of a combination of a plurality of basic colors. The toner image to be output by the image forming device 400 is an image having color mixture of the basic colors, That is, the image forming device 400 outputs an image having color mixture based on an image data array formed of a plurality of colors.

The transfer device 5 includes the transfer belt 47, a drive roller 471, a driven roller 472, a secondary transfer counter roller 473, and a secondary roller 474. The drive roller 471 is driven by a drive source so as to rotate in a direction B illustrated in FIG. 1. The driven roller 472 and the secondary transfer counter roller 473 rotate in the direction B as similar to the drive roller 471. The secondary roller 474 is disposed. opposite the secondary transfer counter roller 473. In the transfer device 5, the secondary roller 474 contacts the transfer belt 47 in the secondary transfer position N, so that a nip portion is formed. In the transfer device 5, the transfer belt 47 and a sheet P are nipped between the secondary roller 474 and the secondary transfer counter roller 473 in the secondary transfer position N, and a secondary transfer bias is applied to transfer the toner image on a surface of the transfer belt 47 to the sheet P. An electric charge opposite to a static charge with which the surface of the transfer belt 47 is charged is applied as the secondary transfer bias of the transfer device 5. After the secondary transfer is performed on the sheet P in the secondary transfer position N, the secondary roller 474 conveys the sheet P to the fixing device 6.

The transfer belt 47 includes low-expansion polyimide resin into which carbon powder for adjustment of electrical resistance is dispersed. The transfer belt 47 is looped around the drive roller 471, the driven roller 472, the secondary transfer counter roller 473, and primary transfer rollers 475Y, 475C, 475M, and 475K.

Figure 2:
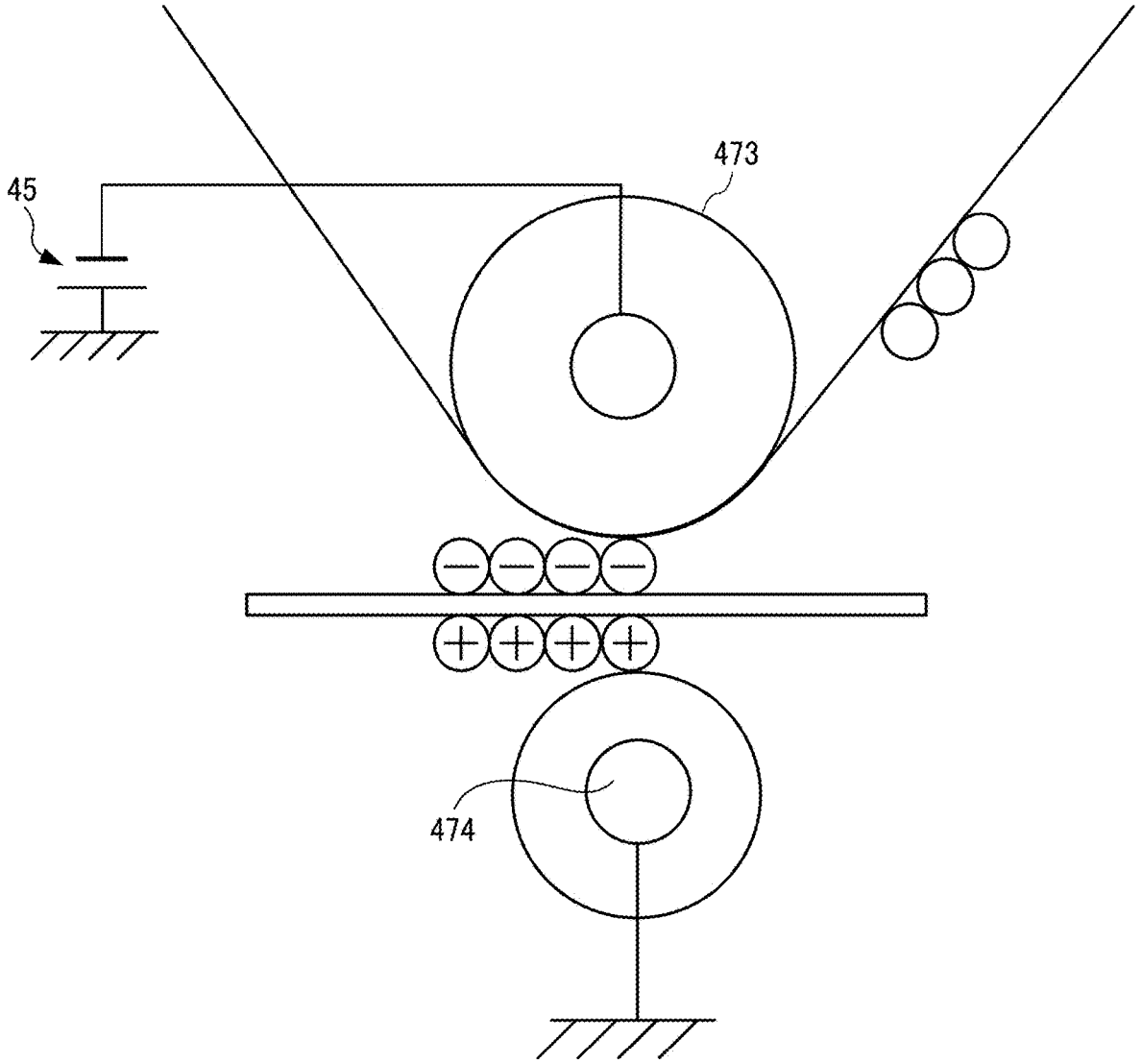
FIG. 2 is a diagram illustrating one example a configuration near a secondary transfer position in the image forming apparatus illustrated in FIG. 1.

In the present embodiment, toner that is a recoding agent has a negatively charged property, and the toner image formed on the transfer belt 47 is transferred to the sheet P by a pressure generated by contact and an electrical repulsive force generated by a negative-polarity voltage applied from the secondary transfer counter roller 473 functioning as a repulsion roller. As illustrated in FIG. 2. the secondary transfer counter roller 473 and the secondary roller 474 are disposed in relative positions such that a sheet P is nipped from above and below. A transfer power source 45 applies a voltage of several kV to the secondary transfer counter roller 473. In the secondary transfer position N, a high voltage causes a small gap discharge to occur, and a front surface that is a printing side of the sheet P and a hack surface of the sheet P are respectively charged with a negative electric charge and a positive electric charge, as illustrated in FIG. 2. Each of the positive and negative polarities described below may have an opposite polarity.

Static electricity by such charging may cause a phenomenon such as a sheet-P-winding jam, a stacking failure in post-processing, and a handling failure of sheets P e.g., sheets are not aligned). Consequently, a method for applying an isolation voltage on a downstream side of the secondary transfer position N in a conveyance direction is considered so that static electricity by charging is removed. Alternatively, a method for removing electricity by rubbing a surface of a sheet P with an electricity removal brush after the sheet P passes through the fixing device 6 is considered so that static electricity by charging is removed. Each of such an electricity removal method is effective for a recording medium such as general paper since an amount of electric current that flows by electric discharge is small and an amount of electric charge for charging is small. However, if a recording medium, such as a resin film and a label, having a high internal resistance is used, an amount of electric charge for charging increases, and an electric charge per se does not tend to move. Consequently, even if a surface of the recording medium is rubbed with an electricity removal brush, removal of the electric charge amount is difficult. Thus, a method for neutralizing an electric charge is also considered. According to the method, an ionizer is used to apply charged particles having a polarity opposite to a polarity of the charging, so that the electric charge is neutralized. However, emission of ion for adequate removal of electricity is difficult. Moreover, since emission of ion increases an amount of electric current, a disadvantage such as an increase in power consumption may occur.

Figure 3:
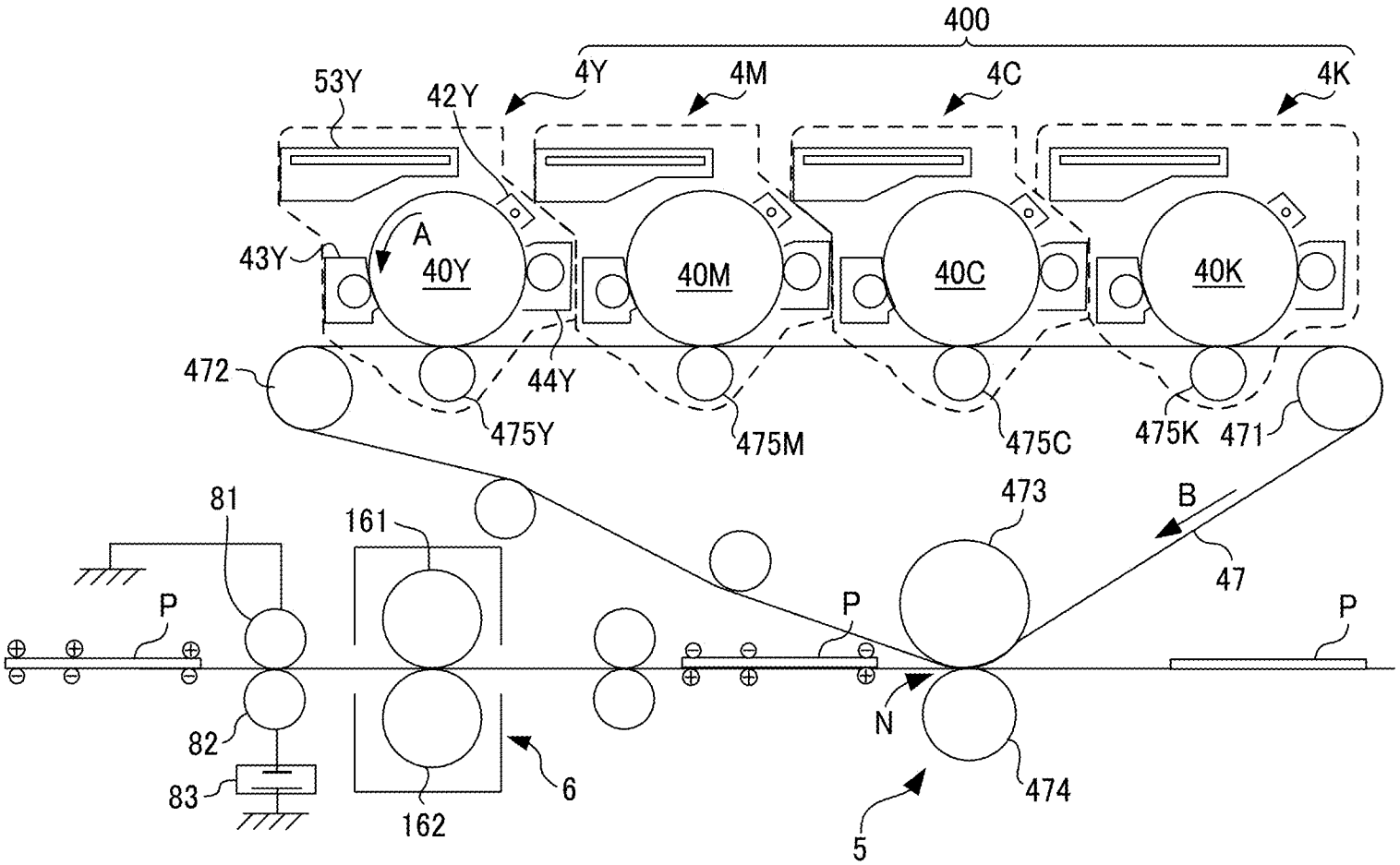
FIG. 3 is a diagram illustrating one example of another configuration of the image forming apparatus.
Figure 4:
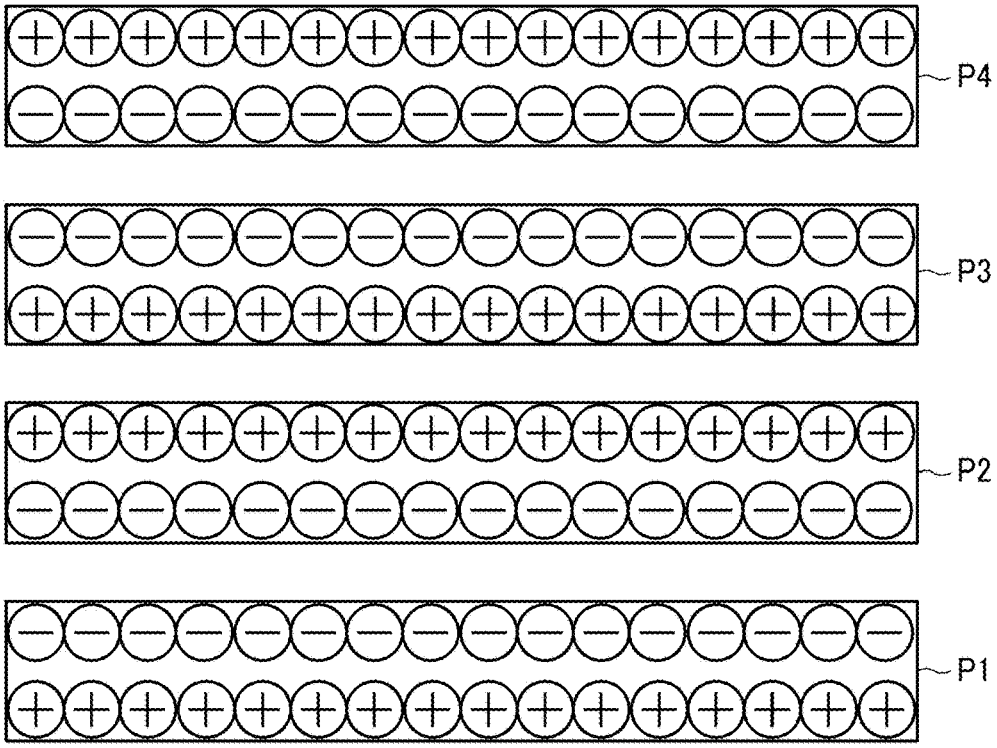
FIG. 4 is a schematic diagram illustrating one example of a charged state when recording media are stacked.

To solve such issues, as illustrated in FIG. 3, it is conceivable that a pair of bias applying rollers 81 and 82 as a charge applying device is disposed downstream from the fixing device 6 on a conveyance path. The pair of bias applying rollers 81 and 82 applies an electric field from below such that a sheet P has a polarity opposite to a polarity in the secondary transfer position N. With the pair of bias applying rollers 81 and 82, a case in which a reverse bias applying operation is performed on an every-other-sheet basis at the time of printing is considered. Herein, a general constant-voltage source is used as a power source 83 for applying a bias. The pair of bias applying rollers 81 and 82 operates such that sheets P are charged with a polarity opposite to a polarity in the secondary transfer position Non an every-other-sheet basis. That is, as illustrated in FIG. 4, if first through fourth sheets are respectively set to sheets P1 through P4, surfaces of sheets P to be adjacent to each other when the sheets P are stacked are charged so as to repel each other. That is, if a front surface as a printing side of each of the sheets P1 and P3 is charged with a negative electric charge, and a back surface of each of the sheets P1 and P3 is charged with a positive electric charge, the sheet P2 is stacked in a state in which a front surface as a printing side and a back surface of the sheet P are respectively charged with a positive electric charge and a negative electric charge.

A description is given of a case in which printing is performed using such configurations. The controller 3 executes a sheet processing program stored in a storage to provide each operation/each function illustrated in FIG. 5. In the description below, each of the functions necessary for the printing is provided by software installed in the controller 3. However, the functions may be entirely or partially provided by hardware such as an integrated circuit (IC).

The sheet processing program may he an installable format or executable format file recorded and provided in a computer-readable recording medium such as a compact disc read only memory (CD-ROM) and a flexible disk (FD). The sheet processing program may be recorded and provided in a computer readable recording medium such as a compact disc-recordable (CD-R), a digital versatile disk (DVD), Blu-ray disk (registered trademark), and a semiconductor memory. Alternatively, the sheet processing program may be installed via a network such as the Internet, or may be preinstalled in a memory such as a read only memory (ROM) inside the device.

Figure 5:
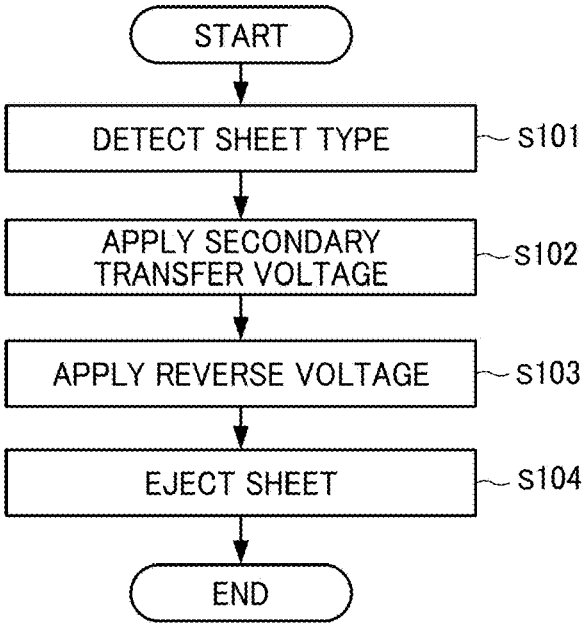
FIG. 5 is a flowchart illustrating one example of an operation performed by the image forming apparatus.

FIG. 5 is a flowchart illustrating a sheet processing operation performed by the image forming apparatus 100. The controller 3 executes the process in the flowchart illustrated in FIG. 3 based on the sheet processing program to prevent adhesion of each sheet.

Particularly, when printing is performed, an operator first designates a type of a sheet P that is a high resistance medium. In step S101, the controller 3 detects the type of the sheet P based on the designation provided by the operator.

Subsequently, in step S102, when the operator performs an operation to start the printing, the controller 3 instructs the secondary transfer counter roller 473 to apply a voltage corresponding to the sheet-P type input in step S101, The voltage corresponding to the sheet-P type is, for example, between of several hundred volts to several thousand volts.

That is, voltage control information is stored in the controller 3. In the voltage control information, a type of a sheet P which is a high-resistance medium such as coated paper and tack paper is stored is associated with a transfer voltage value to be applied to each type of a sheet P. The controller 3 detects a voltage corresponding to the sheet-P type based on the voltage control information, and instructs the transfer power source 45 to apply the voltage.

Accordingly, the voltage corresponding to the sheet-P type is applied to the secondary transfer counter roller 473, so that toner provided by image forming on the transfer belt 47 is transferred to the sheet P. The fixing device 6 applies heat and pressure to the sheet P on which the toner image has been transferred. Thus, the toner is fused, and the image is fixed on the sheet P. The sheet P on which the image has been fixed by the fixing device 6 is conveyed to the pair of bias applying rollers 81 and 82.

Subsequently, in step S103, the controller 3 controls the constant-current power source 84 illustrated in FIG. 1 or the power source 83 illustrated in FIG. 3 such that a reverse voltage with respect to the voltage applied to the sheet P according to the type is applied. In step S104, the sheet ejector 7 ejects the sheet P.

In the example, the reverse voltage (with respect to the secondary transfer counter roller 473) is applied to even-numbered sheets. However, a reverse voltage may be applied to odd-numbered sheets such as a first sheet, a third sheet, and a fifth sheet.

Figure 6:
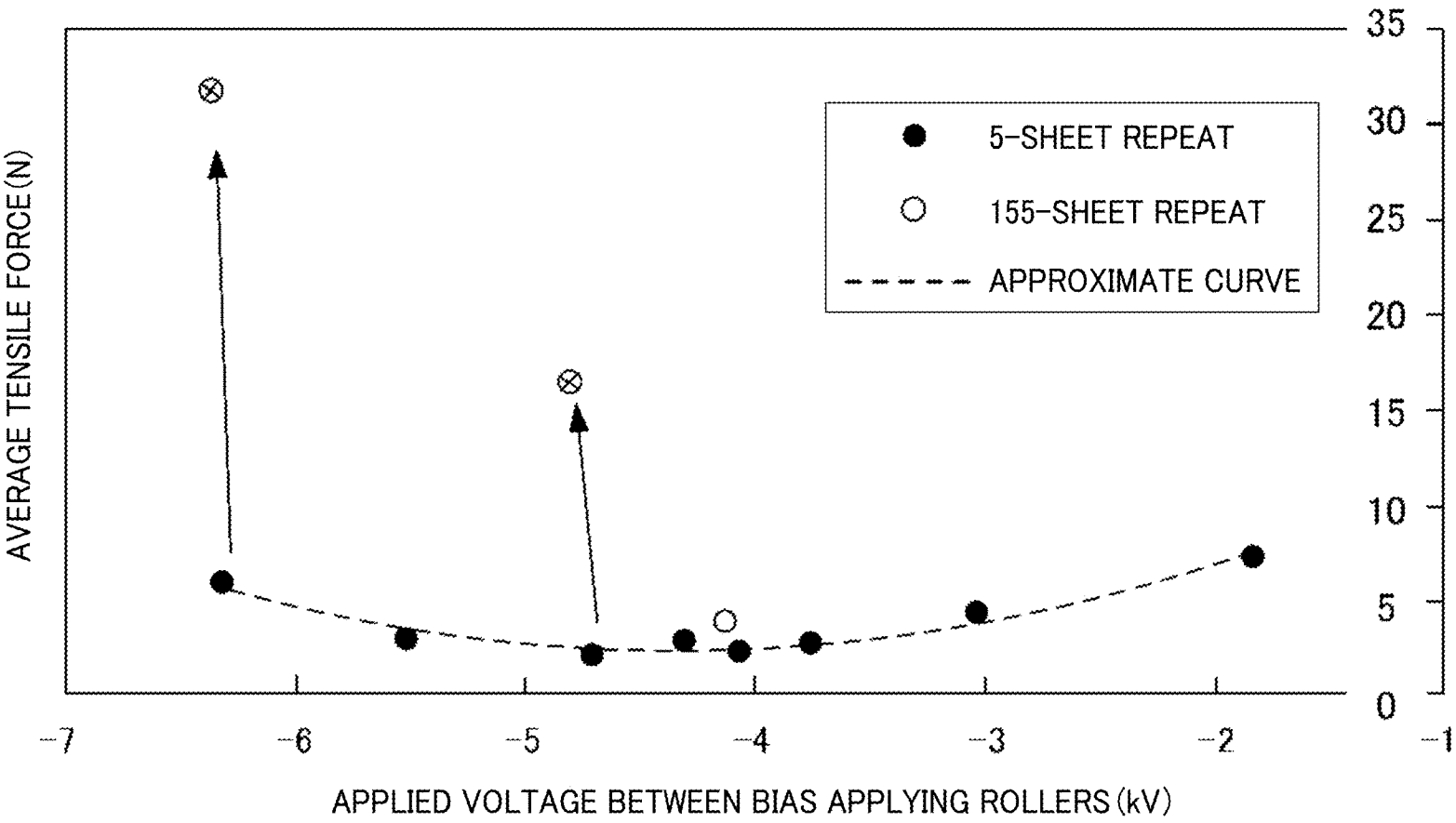
FIG. 6 is a diagram illustrating one example of adhesion strength when a bias is applied.

FIG. 6 is a diagram illustrating a comparative example of an adhesion strength of a sheet P when a bias is applied on an every-other-sheet basis in the configuration illustrated in FIG. 3. The diagram in FIG. 6 illustrates a relation between a constant-voltage-bias applied voltage and a tensile force. In FIG. 6, a hole was made on the top film of four sheets P1 through P4 that overlapped one another, and a tensile force was measured with a digital force gage, so that a film adhesion strength by static electricity was measured. Herein, a bias was applied between the pair of bias applying rollers 81 and 82. A horizontal axis in FIG. 6 indicates such a bias applied between the pair of bias applying rollers 81 and 82 as an applied voltage in units of kV.

If a sheet P is a thick hard film, an adhesion strength is preferably 3 N or smaller. As illustrated in FIG. 6, if the number of sheets that had been fed since bias application. was small (5-sheet repeat), an adhesion strength was efficiently lowered where an applied voltage was in a wide range of 3 kV to 5 kV However, experiments have revealed that if the number of fed sheets was increased (155-sheet repeat), an adhesion strength could be sufficiently lowered where an applied voltage was in one portion of the range near −4 kV whereas an adhesion strength was immediately increased where an applied voltage reached −4.72 kV or greater. In addition, in a case where the adhesion strength was increased, a jam occurred due to sheet adhesion in a conveyance path. In FIG. 6, a white circle with × inside indicates a case in which such a jam occurred before a 155-sheet repeat was completed.

It is conceivable that a reason for such a phenomenon is transfer of heat provided by fixing rollers 161 and 162 disposed in the fixing device 6 to the pair of bias applying rollers 81 and 82 at a later stage via the sheet P. If accumulation of heat is low (5-sheet repeat), the operation is performed without a problem. However, accumulation of heat may become higher (155-sheet repeat), and a temperature may rise in such an extent that an electrical resistance is decreased. In such a case, an amount of electric current to flow increases due to the decrease in electrical resistance despite the same bias applied voltage. As a result, it is conceivable that an amount of electric charge to flow to the sheet P increases, and reverse charging occurs.

According to the present embodiment, as illustrated in FIG. 1, the constant-current power source 84 is used as a power source that applies a bias to the pair of bias applying rollers 81 and 82. Thus, control by a constant-current limits an electric charge amount (i.e., an electric current value) flowing from the constant-current power source 84 to a sheet P per unit time to a certain range even if, for example, electric discharge occurs. That is, even if an electrical resistance of the sheet P is decreased by accumulation of heat, the use of the constant-current power source 84 can limit an electric charge amount to flow, and thus does not cause an increase in charging.

Figure 7:
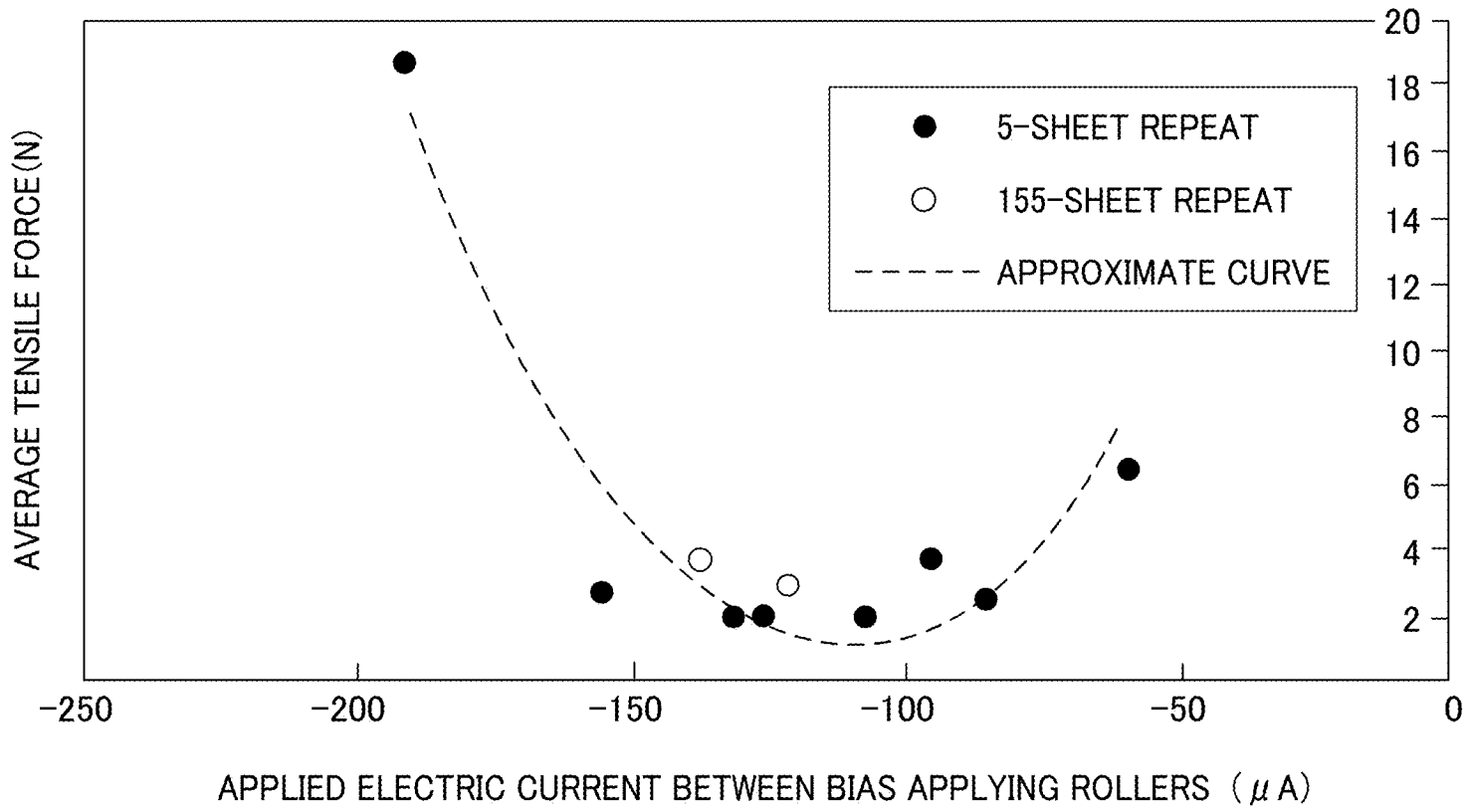
FIG. 7 is a diagram illustrating one example of adhesion strength when constant-current control is performed.
Figure 8:
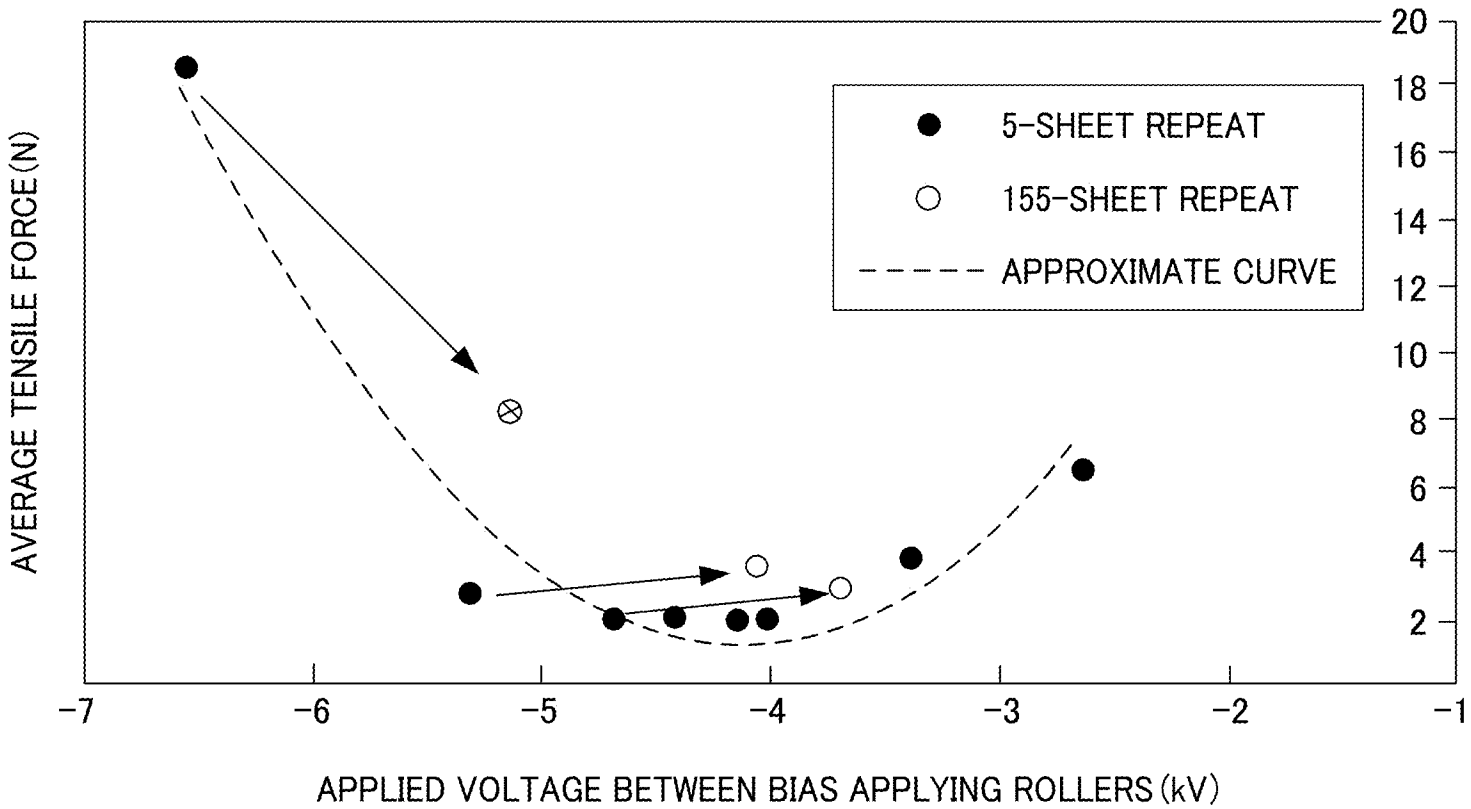
FIG. 8 is a diagram similar to the diagram illustrated in FIG. 7, but a horizontal axis indicates a voltage.

As for the image forming apparatus 100 with such a configuration, FIG. 7 illustrates a result of experiments using an adhesion strength measurement method that is similar to the method described with reference to FIG. 6. Unlike the diagram illustrated in FIG, 6, a horizontal axis in FIG. 7 indicates an electric current value μA. The diagram in FIG. 7 illustrates a relation between a constant-voltage-bias applied current and a tensile force. As is clear from FIG. 7, the use of the constant-current power source 84 to perform control with a certain electric current value (whin the range of 155 μA to 131 μA in FIG. 7) could prevent electrostatic adhesion. The voltage herein was between −5.31 kV and −4.68 kV as illustrated in FIG. 8. The diagram in FIG. 8 illustrates a relation between a constant-voltage-bias applied voltage and a tensile force.

According to the configuration of the present embodiment described above, therefore, the image forming method is performed using the image forming device 400 which forms a toner image on a sheet P, the fixing device 6 which fixes the toner image on the sheet P, and the pair of bias applying rollers 81 and 82 which apply electric charges to the sheet P on which the toner image has been fixed by the fixing device 6, in a state in which the output-adjustable constant-current power source 84 for the bias applying rollers 81 and 82 has an electric current that is controlled to be constant. With such a configuration, the sheet P subsequent to image formation is charged by the pair of bias applying rollers 81 and 82, thereby preventing adhesin of the sheet P. Moreover, even if the number of sheets to be printed is repeatedly large, a reduction effect by which sheet adhesion due to static electricity is reduced remains, and an electrostatic sheet-jam does not occur in a conveyance path of the apparatus.

In the present embodiment, moreover, an electric charge having a polarity opposite to a surface potential of the sheet P subsequent to fixing is applied on an every-other-sheet basis to the sheets on which images are successively formed. According to such a configuration, only even-numbered sheets or odd-numbered sheets subsequent to image formation are charged by the pair of bias applying rollers 81 and 82. Thus, the charged sheets P has a polarity opposite to the odd-numbered sheet or even-numbered sheet, thereby further preventing adhesion of the sheet P.

In the present embodiment, moreover, a voltage having a polarity opposite to a surface potential of the sheet P subsequent to fixing is applied to the sheet P. Such a method enables surfaces of sheets P facing each other are charged with static electricity so as to repel each other, thereby further preventing adhesion of the sheet P.

In the present embodiment, moreover, the pair of bias applying rollers 81 and 82 is connected to the output-adjustable constant-current power source 84, and has a function as a charge applying device that applies an electric charge to the sheet P on which a toner image has been fixed by the fixing device 6. According to such a configuration, a sheet P is charged by the pair of bias applying rollers 81 and 82, so that adhesion of sheet P can be prevented.

In the present embodiment, moreover, the pair of bias applying rollers 81 and 82 has a function as a reverse-polarity applying device that applies an electric charge having a polarity opposite to a surface potential of the sheet P subsequent to fixing on an every-other-sheet basis to the sheets P on which images are successively formed. According to such a configuration, even if the number of sheets is repeatedly large, a reduction effect by which sheet adhesion due to static electricity is reduced remains, and an electrostatic sheet-jam is prevented in a conveyance path of the apparatus.

The present disclosure has been described with reference to a specific embodiment, but is not limited thereto. The present disclosure can encompass various configurations within the scope of the following claims.

For example, the image forming apparatus of the present disclosure has been described using an example case in which single-color developer is used. However, the present disclosure may be applied to an image forming apparatus capable of printing an image with other colors.

Moreover, the present disclosure has been described above with reference to suitable effects, but is not limited thereto.

The present disclosure has been described above with reference to specific embodiments but is not limited thereto. Various modifications and enhancements are possible without departing from scope of the disclosure. It is therefore to be understood that the present disclosure may be practiced otherwise than as specifically described herein. For example, elements and/or features of different illustrative embodiments may be combined with each other and/or substituted for each other within the scope of the present disclosure.

What is claimed is:

1. An image forming method comprising:

forming a toner image on a recording medium;

fixing the toner image on the recording medium; and applying an electric charge to the recording medium on which the toner image has been fixed, in a state in which an output-adjustable power source has an electric current that is controlled to be constant, wherein the applying applies the electric charge having a polarity opposite to a surface potential of the recording medium subsequent to the fixing to a plurality of recording media including the recording medium on an every-other-medium basis such that only even-numbered sheets or only odd number sheets have the electric charge having a positive polarity applied thereto without applying the electric charge having the positive polarity applied to the odd-numbered or even numbered sheets respectively, the plurality of recording media being on which images are successively formed.

2. The method according to claim 1, wherein:

toner of the toner image has a negatively charged property.

3. The method according to claim 2, wherein:

the applying a charge applies a negative-polarity voltage.

4. The method according to claim 1, wherein:

a voltage of the electric charge of the applying varies in response to a type of a sheet.

5. The method according to claim 1, wherein:

a voltage of the electric charge of the applying varies in response to a resistance of a sheet.

6. An image forming apparatus comprising:

an image forming device configured to form a toner image on a recording medium;

a fixing device configured to fix the toner image on the recording medium with heat;

a charge applying device configured to apply an electric charge to the recording medium on which the toner image has been fixed by the fixing device; and an output-adjustable power source configured to cause the charge applying device to apply the electric charge to the recording medium, in a state in which the output-adjustable power source has an electric current that is controlled to be constant, wherein the charge applying device is configured to apply an electric charge having a polarity opposite to a surface potential of the recording medium subsequent to fixing performed by the fixing device to a plurality of recording media including the recording medium on an every-other-medium basis such that only even-numbered sheets or only odd number sheets have the electric charge having a positive polarity applied thereto without applying the electric charge having the positive polarity applied to the odd-numbered or even numbered sheets respectively, the plurality of recording media being on which images are successively formed.

7. The method according to claim 1, wherein:

toner of the toner image has a positively charged property.

8. The method according to claim 7, wherein:

the applying a charge applies a positive-polarity voltage.

9. The apparatus according to claim 6, wherein:

toner of the toner image has a negatively charged property.

10. The apparatus according to claim 9, wherein:

the charge applying device applies a negative-polarity voltage.

11. The apparatus according to claim 6, wherein:

toner of the toner image has a positively charged property.

12. The apparatus according to claim 11, wherein:

the charge applying device applies a positive-polarity voltage.

13. The apparatus according to claim 6, wherein:

a voltage of the electric charge applied by the charge applying device varies in response to a type of a sheet.

14. The apparatus according to claim 6, wherein:

a voltage of the electric charge applied by the charge applying device varies in response to a resistance of a sheet.

* * * * *